United States Patent [19]

Jones

[11] 4,041,873

[45] Aug. 16, 1977

[54] DRIVERLESS VEHICLE TURNTABLE SYSTEM

[75] Inventor: Vercoe C. Jones, Easton, Pa.

[73] Assignee: Si Handling Systems, Inc., Easton, Pa.

[21] Appl. No.: 607,164

[22] Filed: Aug. 25, 1975

[51] Int. Cl.[2] ..... B61J 1/02; B61B 13/12

[52] U.S. Cl. ..... 104/35; 104/99; 104/166; 104/252

[58] Field of Search ..... 104/35, 36, 38, 48, 104/99, 106, 47, 249, 252, 37, 39, 40, 43, 44, 45, 46, 166; 105/28

[56] References Cited

U.S. PATENT DOCUMENTS

| | | | |
|---|---|---|---|
| 166,975 | 8/1875 | Eppelsheimer | 104/35 |
| 2,071,135 | 2/1937 | McGiffert et al. | 105/28 |
| 3,898,935 | 8/1975 | Norlie et al. | 104/37 |
| 3,903,810 | 9/1975 | Jones | 104/166 |

FOREIGN PATENT DOCUMENTS

| | | | |
|---|---|---|---|
| 655,321 | 5/1928 | France | 104/35 |

*Primary Examiner*—Robert J. Spar
*Assistant Examiner*—Carl Rowold
*Attorney, Agent, or Firm*—Seidel, Gonda & Goldhammer

[57] ABSTRACT

A driverless turntable system is disclosed and includes two turntables coupled together for simutaneous rotation in opposite directions. A driverless vehicle enters the first turntable, is transferred to the second turntable, and then exits from the second turntable in a direction parallel to that when it entered the first turntable. Stationary tracks are provided adjacent the turntables for guiding the vehicles thereonto and therefrom.

12 Claims, 7 Drawing Figures

10
12
14
16
18
20
22
24
26
28
30
32
34
35
42
44
46
70
72
74
76
78
80
82
83
84
86
88
90
92
94
96
98
100
104
106
107
110
113

FIG. 2
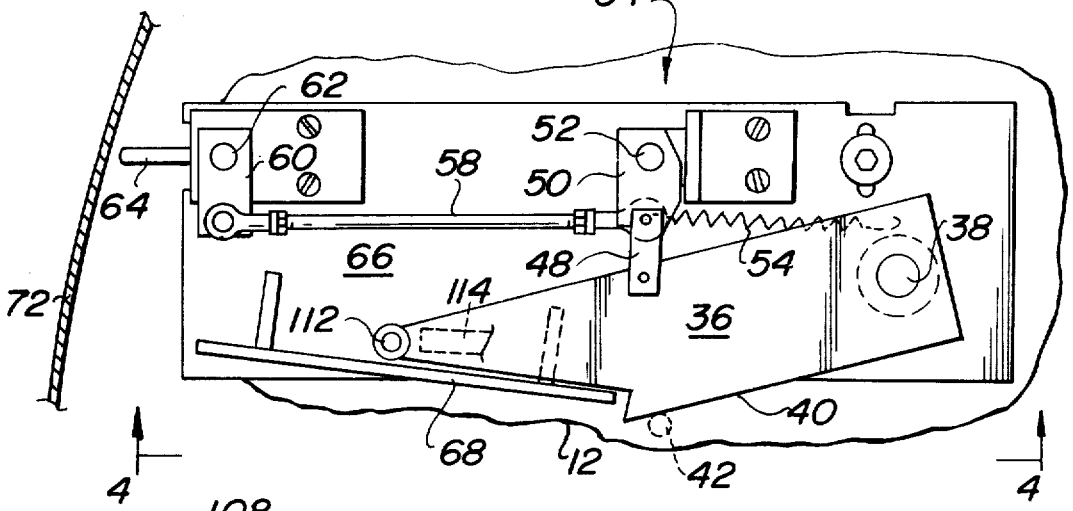
FIG. 3
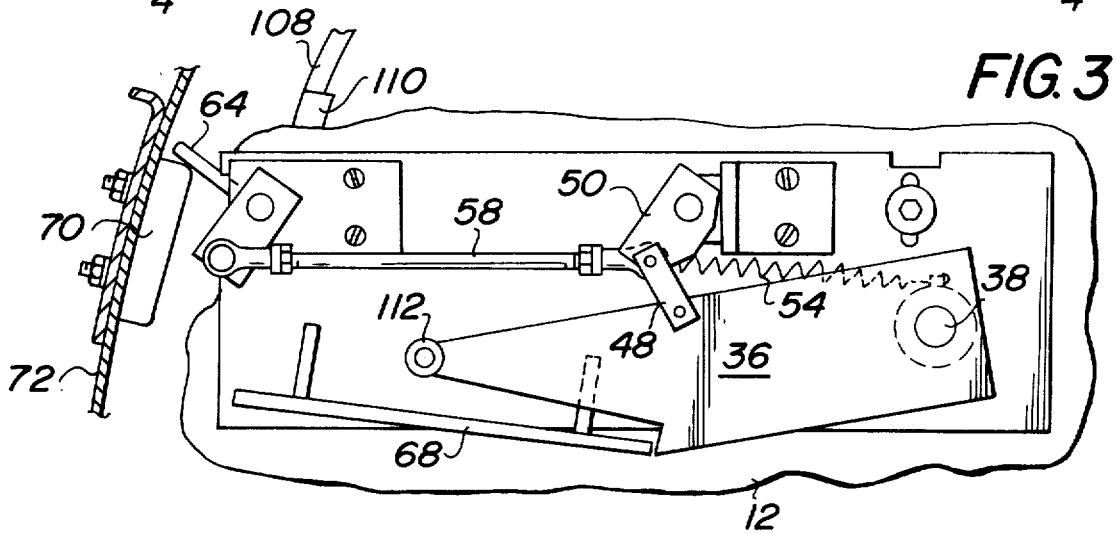
FIG. 4
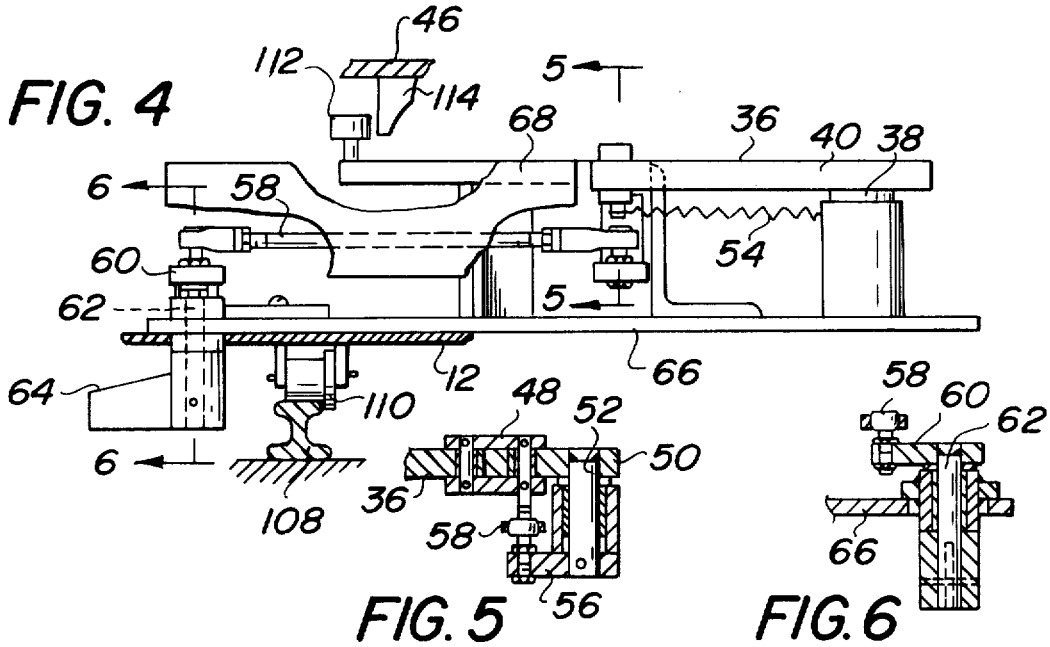
FIG. 5
FIG. 6

DRIVERLESS VEHICLE TURNTABLE SYSTEM

BACKGROUND

A system of the type involved herein is classified in class 104. U.S. Pat. Nos. 3,356,040 and 3,818,837 are exemplary of the type of vehicle adapted to be used by the present invention.

The present invention is directed to a driverless vehicle turntable system including first and second sets of tracks. Means including first and second turntables interconnected for simultaneous rotation are provided for transferring driverless vehicles from said first set of tracks to said second set of tracks.

In a specific embodiment of the present invention, a motor is connected to the first turntable for rotating the first turntable. A connecting rod is pivotably connected at its ends to each of said turntables so as to cause the second turntable to rotate with said first turntable but in opposite directions. The turntables are preferably interconnected and driven so as to rotate through an arc of 90° in a situation wherein it is desired to have the vehicle move along the second set of tracks in an opposite direction with respect to the direction it was moving along the first set of tracks.

It is an object of the present invention to provide a novel driverless vehicle turntable system for transferring a driverless vehicle from one set of tracks to another set of tracks.

It is another object of the present invention to provide a turntable system for driverless vehicles which is automatic, reliable, and requires little or no maintenance.

It is another object of the present invention to provide a turntable system for driverless vehicles which includes drive means on the turntables for causing movement of a vehicle thereon.

Other objects will appear hereinafter.

For the purpose of illustrating the invention, there is shown in the drawings a form which is presently preferred; it being understood, however, that this invention is not limited to the precise arrangements and instrumentalities shown.

FIG. 2 is an enlarged detail view of a portion of one of the turntables in FIG. 1.

FIG. 3 is a view similar to FIG. 2 but showing the position of elements after rotation through an arc of 90°.

FIG. 4 is a view taken along the line 4—4 in FIG. 2.

FIG. 5 is a view taken along the line 5—5 in FIG. 4.

FIG. 6 is a view taken along the line 6—6 in FIG. 4.

Figures 1, 7:
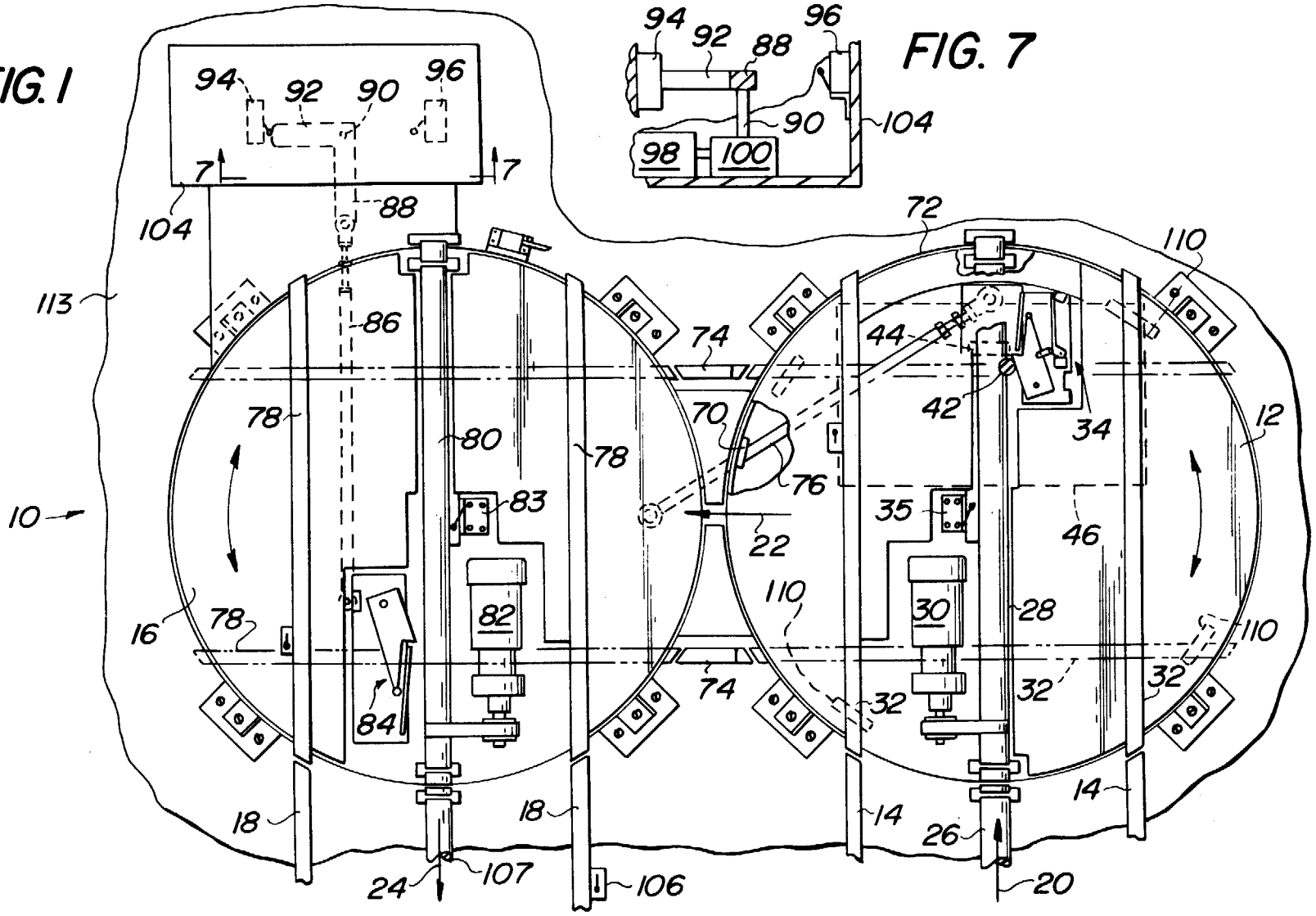
FIG. 1 is a top plan view of the system of the present invention.
FIG. 7 is a view taken along the line 7—7 in FIG. 1.

Referring to the drawing in detail, wherein like numerals indicate like elements, there is shown in FIG. 1 a top plan view of the system 10 of the present invention.

The system 10 enables a driverless vehicle of the type disclosed in said aforementioned patents to move from the stationary tracks 14 onto the turntable 12, transfer from turntable 12 to turntable 16, and then transfer onto the stationary tracks 18. Thus, in the illustrated embodiment the vehicle will change its direction 180° from movement in the direction of arrow 20, to movement in the direction of arrow 22, to movement in the direction of arrow 24.

While moving along tracks 14, the vehicle is driven by drive shaft 26. While on turntable 12, the vehicle is driven by drive shaft 28 which is coaxial with drive shaft 26. Suitable bearings are provided on the turntable 12 to rotatably support the drive shaft 28. A motor 30 has its output coupled to the drive shaft 28 by an endless belt or the like to facilitate rotation of shaft 28 about its longitudinal axis.

The turntable 12 is provided with a pair of tracks 32 which are aligned with the tracks 14 when the turntable 12 is in its vehicle receiving position, namely the position shown in FIG. 1. The ends of tracks 32 adjacent the tracks 14 in the vehicle receiving position are the inlet end of the tracks. The opposite ends of the tracks 32 are the discharge ends. Adjacent the discharge ends of the tracks 32, there is provided on the turntable 12 a vehicle stopping mechanism designated generally as 34. A microswitch 35 is provided on the turntable 12 in a location so that it may be tripped by a vehicle moving along the drive shaft 28.

The mechanism 34 is shown in detail in FIG. 2. The mechanism 34 includes a cam 36 mounted for pivotable movement about the upright pin 38. Cam 36 has a cam surface 40 adapted to contact a cam follower 42 supported by the vehicle shown in phantom and designated 46. The cam follower 42 controls the rotative position of the wheel 44 on the vehicle 46 with respect to the longitudinal axis of the dirve shaft 28. When wheel 44 rotates about an axis parallel to the longitudinal axis of drive shaft 28, the vehicle 46 is stopped. The wheel 44 is spring biased to a position wherein it rotates about an axis at an acute angle of about 35–45° with respect to the longitudinal axis of drive shaft 28.

In the position of cam 36 as shown in FIG. 2, cam surface 40 offers resistance to follower 42 and causes follower 42 and the wheel 44 to rotate. In this regard, rotation of cam 36 in a clockwise direction in FIG. 2 about the axis of pin 38 is resisted by links 48 and 50. Link 48 has one end pivotably connected to cam 36. Link 50 is pivotably mounted for rotation about the vertical pin 52. The links 48 and 50 are pivotably connected together and spring biased to their locked position as shown in FIG. 2 by a spring 54.

As link 50 rotates, it causes pin 52 to rotate. Pin 52 is supported by a bearing and is connected to a link 56. Link 56 is pivotably connected to one end of a rod 58. The other end of rod 58 is pivotably connected to one end of a link 60. Link 60 is connected to a pivot end 62. Pin 62 is connected to a finger 64. Finger 64 and rod 58 are generally parallel to the longitudinal axis of drive shaft 28.

The mechanism 34 is mounted on a base plate 66 so that the entire mechanism may be mounted on the table 12 as a unit. An acceleration control plate 68 is mounted on plate 66. The included angle between cam surface 40 and the longitudinal axis of drive shaft 28 is substantially the same as the included angle between the longitudinal axis of drive shaft 28 and the vertically disposed plate 68. Hence, contact between cam follower 42 and the vertically disposed side face of plate 68 controls the rate at which wheel 44 will rotate and hence will control the rate of acceleration of the vehicle 46 when it is permitted to pass beyond the cam surface 40.

A stationary guide plate 72 is mounted on the floor surrounding the table 12. As shown in FIG. 1 and 3, between the 9 and 10 o'clock position on the plate 72, there is provided a limit stop 70 which is contacted by the finger 64 when the table 12 is caused to rotate in a counterclockwise direction in FIG. 1 as will be made clear hereinafter. A connecting rod 76 has one end pivotably connected to the table 16 at about the 3 o'- clock position. The other end of the connecting rod 76 is pivotably connected to the table 12 at the 12 o'clock position. See FIG. 1.

The table 16 has a set of tracks 78 which are aligned with the set of tracks 18. Table 16 is provided with a drive shaft 80 which is parallel to the drive shaft 28. Drive shaft 80 is suitably supported at its ends by bearings on the table 16. A motor 82 on the table 16 is coupled to the drive shaft 80 in the same manner as described above. A limit switch 83 is provided on the table 16 in a position so as to be tripped by the vehicle 46 as described hereinafter. Table 16 is also provided with a mechanism 84 which is identical with mechanism 34. While mechanism 34 is located on table 12 adjacent the 12 o'clock position, mechanism 84 which is identical thereto is located adjacent the 6 o'clock position on table 16.

a connecting rod 86 has one end pivotably connected to the table 16 adjacent the location of the mechanism 84. The connecting rod 86 is parallel to the drive shaft 80. The other end of connecting rod 86 is pivotably connected to one end of the L-shaped crank arm 88. Crank arm 88 is pivotably supported by an upright shaft 90. Crank arm 88 has an extension 92 which is adapted to alternatively trip microswitches 94 and 96 which are diametrically opposite one another.

A motor 98 drives the shaft 90 through a speed reducer 100 and a clutch not shown but of conventional construction. The motor 98, speed reducer 100, shaft 90, crank arm 92, and the switches 94, 96 are disposed within a housing 104 having an access door. The length of the crank arm 88 from shaft 90 to its connection with connecting rod 86 is sufficient so that when crank arm 88 rotates through an arc of 180°, connecting rod 86 will have rotated the table 16 through an arc of 90°.

A drive shaft 107 is suitably supported by bearings between the tracks 18 coaxial with the drive shaft 80. A microswitch 106 is supported adjacent the tracks 18 in a position so as to tripped by the vehicle 46 when it passes thereabove and is travelling in the direction of arrow 24 while being supported by the tracks 18.

The system 10 operates in the following manner.

Let it be assumed that the turntable 12 and 16 are in the position as shown in FIG. 1. Let it be assumed that motor 100 is continuously operating but the clutch is in an inoperative position so that shaft 90 is not rotating. Vehicle 46 is supported by tracks 14 while it is being driven by drive shaft 26. As the vehicle 46 enters onto the turntable 12, drive shaft 28 driven by motor 30 causes the vehicle 46 to move therealong toward the mechanism 34. The vehicle 46 trips the microswitch 35 which closes a clutch between shaft 90 to motor 98.

As the vehicle moves along the shaft 28, cam follower 42 on the vehicle 46 contacts the cam surface 40 and rotates the drive wheel 44 to the position shown in FIG. 1 whereby the vehicle 46 comes to a stop. At this point in time, table 12 is rotating in a counterclockwise direction in FIG. 1. When shaft 90 starts to rotate due to the tripping of microswitch 35, connecting rod 86 rotated table 16 in a clockwise direction in FIG. 1. Connecting rod 76 caused table 12 to rotate in a counterclockwise direction in FIG. 1.

When crank arm 88 has rotated through an arc of 180°, its extension 92 contacted microswitch 96 thereby opening the clutch between shaft 90 and the motor 98. The turntables stop rotating. At this point in time, the tracks 32 on table 12 are aligned with the tracks 78 on table 16 and the stationary tracks 74. Also, finger 64 contacted limit stop 70 thereby causing the cam 36 to rotate in a clockwise direction from the position shown in FIG. 2 to the position shown in FIG. 3 to release the vehicle 46.

When the cam 36 is in the position shown in FIG. 3, the spring bias on drive wheel 44 rotates wheel 44 and follower 42. Rotation of follower 42 is controlled by contact with the side face of plate 68. The vehicle 46 then transfers off tracks 32, passes over the stationary tracks 74, and then onto the tracks 78 of turntable 16.

The vehicle 46 trips microswitch 83 as it passes thereover. The vehicle continues along the tracks 78 until it is stopped by the mechanism 84 in the same manner as described above. Tripping of microswitch 83 closes the clutch between shaft 90 and motor 98. Hence, crank arm 88 rotates through another cycle of 180° until extension 92 contacts microswitch 94. During this 180° travel of the crank arm 88, the tables 12 and 16 are returned to the receiving and discharge position shown in FIG. 1. The front end of the vehicle 46 is now pointing in the direction of arrow 24.

When the table 16 has returned to the discharge position shown in FIG. 1, a finger on table 16 comparable to finger 64 will release the cam of mechanism 84 in the same manner as described above whereby the drive shaft 80 will cause the vehicle to discharge from the table 16 and transfer onto the tracks 18. When the vehicle 46 has been transferred onto the tracks 18, drive shaft 107 will cause the vehicle 46 to be propelled in the direction of arrow 24. Also, the vehicle 46 will trip microswitch 106 which activates microswitch 35. Until microswitch 106 is activated, tripping of microswitch 35 is ineffective to cause any rotation of the tables 12, 16. Thus, microswitch 106 is a safety feature to prevent an incoming vehicle from initiating rotative movement of the tables 12 and 16 until after an outgoing vehicle has been transferred onto the tracks 18.

As a safety feature, the cam 36 is preferably provided with a limit stop 112. Limit stop 112 is adapted to be contacted by a depending bracket arm 114 on the vehicle 46. The bracket arm 114 is positioned in a location so as to contact limit stop 112 before the follower 42 can transfer off the cam surface 40 onto the acceleration control plate 68.

The drive shafts 26, 28, 80 and 107 are continuously driven. It will be noted that the entire system is automatic so as not to require an operator notwithstanding the fact that the vehicle 46 is also a driverless vehicle. The number of wheels 110 on each of the turntables 12 and 16 may be varied as desired. It is preferred to provide at least four such wheels on each turntable, with the wheels being approximately 90° from each other. As shown in FIG. 4 the wheels 110 are guided on a track 108.

It will be appreciated that various features are not shown for purposes of simplicity of illustration and that the same are conventional or in view of the above will be obvious to a man skilled in the art such as circuitry connecting the microswitches with the clutch for motor 98, substructure framing so that the tables 12 and 16 rotate about vertical axes, etc. The entire system may be mounted on a floor 113 or on support structure at an elevation above floor level for ease of operator access to the articles supported and carried by the vehicles 46. While motor 98 is coupled to turntable 16, it will be apparent that it could be coupled to turntable 12 instead. If it is desired to have vehicles discharge from table 16 in a direction opposite to the direction of arrow 24, the tables 12, 16 will rotate 90° in the same direction by attaching one end of rod 76 to table 12 adjacent the 3 o'clock position thereon in FIG. 1 and the other end of rod 76 to table 16 adjacent the 6 o'clock position.

The present invention may be embodied in other specific forms without departing from the spirit or essential attributes thereof and, accordingly, reference should be made to the appended claims, rather than to the foregoing specification as indicating the scope of the invention.

It is claimed:

1. A driverless vehicle turntable system comprising first and second stationary track, first and second turntables interconnected for simultaneous rotation for transferring driverless vehicles from said first set of tracks to said second set of tracks, each turntable having a set of tracks aligned with a set of tracks on the other turntable in one position of the turntables, each set of turntable tracks being aligned with one of said first and second sets of tracks in another position of the turntables, a discrete rotatable drive shaft on each turntable for propelling a vehicle supported by its associated turntable, said drive shafts being coaxial when the tracks on said turntables are aligned with each other, and stationary tracks between and adjacent said turntables, said last-mentioned stationary tracks being aligned with the tracks on said turntables when said drive shafts are coaxial, a motor coupled to said first turntable for rotating said first turntable, and a connecting rod pivotably connected at its ends to said turntables so that said first turntable causes said second turntable to rotate in an opposite direction.

2. A system in accordance with claim 1 wherein each turntable has a discrete releasable mechanism thereon for selectively causing a vehicle to stop at a predetermined location on each turntable, each of said discrete releasable mechanisms being automatically movable to a position wherein it permits a vehicle to move off its associated turntable.

3. A system in accordance with claim 1 wherein said motor includes a rotary drive shaft coupled to said first turntable by way of a crank arm mounted to said drive shaft and a coupling rod pivotably mounted at one of its end to said crank arm and pivotably mounted at its other end to said first turntable.

4. A turntable system for transferring driverless vehicles between first and second sets of tracks comprising means including first and second turntables for transferring vehicles from a first set of tracks to a second set of tracks, each turntable having a set of tracks thereon, each turntable being rotatable about an upright axis so that tracks on the first turntable can be aligned with tracks on the second turntable in a vehicle transfer position of the turntables, means interconnecting said turntables for simultaneous rotation in opposite directions, means for rotating said turntables, a discrete vehicle propelling means supported on each turntable, selectively controlled vehicle stop means on each turntable for stopping a vehicle and interrupting the propelling effect of said vehicle propelling means, switches on said turntable for initiating rotation of said turntables, one said switch being on one turntable to initiate rotation of said one turntable in a first direction, and another switch being on the other turntable for initiating rotation of said one turntable in an opposite direction.

5. A turntable system for transferring driverless vehicles between first and second sets of tracks comprising means including first and second turntables for transferring vehicles from a first set of tracks to a second set of tracks, each turntable having a set of tracks thereon, each turntable being rotatable about an upright axis so that tracks on the first turntable can be aligned with tracks on the second turntable in a vehicle transfer position of the turntables, means interconnecting said turntables for simultaneous rotation in opposite directions, a discrete vehicle propelling means supported on each turntable, and selectively controlled vehicle stop means on each turntable for rotation therewith for stopping a vehicle and interrupting the propelling effect of said vehicle propelling means.

6. A system in accordance with claim 5 wherein said first and second sets of tracks are parallel to one another in one position of the turntables, and a motor means connected to said first turntable for intermittently rotating said first turntable and then automatically interrupting such rotation after said first turntable has rotated through an arc of about 90°.

7. A system in accordance with claim 6 including a set of stationary tracks disposed between said turntables so as to be aligned with said tracks on said first and second turntables when said turntables are in their vehicle transfer position.

8. A system in accordance with claim 7 including switches on said turntables for initiating rotation of said turntables, one said switch being on one turntable to initiate rotation of said one turntable in a first direction, another switch being on the other turntable for initiating rotation of said one turntable in an opposite direction.

9. A system in accordance with claim 5 wherein each turntable has a discrete releasable mechanism thereon for selectively causing a vehicle to stop at a predetermined location on each turntable, each of said mechanisms being automatically movable to a position wherein it permits a vehicle to be driven off its associated table by its associated propelling means.

10. A system in accordance with claim 9 wherein said discrete releasable mechanism includes a cam surface secured to each turntable adapted to engage a cam follower on said vehicle and thereby interrupt the propelling effect of said vehicle propelling means.

11. A system in accordance with claim 10 wherein said discrete releasable mechanism includes a means for moving said cam surface to allow the propelling effect of said vehicle propelling means to drive a vehicle off its associated table.

12. An automatic driverless turntable system comprising first and second horizontally disposed turntables rotatable about vertical axes, a set of tracks on each turntable, the tracks on said first turntable being parallel to said tracks on said second turntable in a vehicle receiving position of one of the turntables, when said one turntable is in a vehicle receiving position the other turntable being in a vehicle discharge position, the tracks on said first turntable being aligned with the tracks on said second turntable in a vehicle transfer position of said turntables, a motor means connected to one of said turntables for intermittently rotating said first turntable from a vehicle discharge position to its vehicle transfer position and then interrupting such rotation, a first switch means on said second turntable for initiating such rotation of the first turntable by said motor means, a second switch for initiating rotation of the first turntable from its vehicle transfer position to its vehicle discharge position by said motor means, means interconnecting said turntables for simultaneous rotation, a discrete drive shaft rotatably supported on each turntable between the tracks of each turntable, a discrete motor on each turntable coupled to its associated drive shaft, said drive shafts being parallel to each other when said one turntable is in its vehicle receiving position, and selectively controlled discrete vehicle stop means on each turntable for selectively stopping a vehicle and then permitting the vehicle to move off its associated turntable under the driving effect of its associated drive shaft as a function of the rotary position of the turntables.

* * * * *